United States Patent [19]

Kawano et al.

[11] Patent Number: 5,012,286

[45] Date of Patent: Apr. 30, 1991

[54] IMAGE FORMING APPARATUS HAVING DEVICE FOR DETECTING CONCENTRATION OF DEVELOPING AGENT

[75] Inventors: Hisaaki Kawano, Kawasaki; Yasufumi Tanimoto, Fujisawa; Kouji Ishida, Kawasaki, all of Japan

[73] Assignee: Kabushiki Kaisha Toshiba, Kawasaki, Japan

[21] Appl. No.: 226,195

[22] Filed: Jul. 29, 1988

[30] Foreign Application Priority Data

Jul. 31, 1987 [JP] Japan ..... 62-191613

[51] Int. Cl.[5] ..... G03G 21/00; G03G 15/06

[52] U.S. Cl. ..... 355/246; 355/208

[58] Field of Search ..... 355/245, 246, 259, 260, 355/206, 208

[56] References Cited

U.S. PATENT DOCUMENTS

| | | | |
|---|---|---|---|
| 4,155,638 | 5/1979 | Blitzer | 355/246 |
| 4,260,073 | 4/1981 | Baumann | 355/246 X |
| 4,572,661 | 2/1986 | King | 355/246 |
| 4,671,646 | 6/1987 | Florack et al. | 355/246 |
| 4,708,458 | 11/1987 | Ueda et al. | 355/246 |
| 4,742,372 | 5/1988 | Takahashi | 355/246 |
| 4,851,875 | 7/1989 | Tanimoto | 355/245 |
| 4,873,549 | 10/1989 | Tada et al. | 355/246 X |

FOREIGN PATENT DOCUMENTS

| | | |
|---|---|---|
| 60-52878 | 3/1985 | Japan . |
| 2180472 | 4/1987 | United Kingdom . |

*Primary Examiner*—Fred L. Braun

*Attorney, Agent, or Firm*—Foley & Lardner

[57] ABSTRACT

In an image forming apparatus, a developing unit for developing a latent image on a photosensitive drum is detachably mounted in the apparatus and is provided with a identification signal generator for each particular developing unit. When the developing unit is replaced by a new one, an identification signal generated from the generator is compared in a CPU with reference identification data stored in a memory. When the generated identification signal differs from the stored reference identification data, the generated identification signal is stored as a new reference data in the memory and a toner concentration signal generated from the sensor is also stored as new reference toner concentration data in the memory. Thus, a desired toner concentration can be maintained even through developing units are replaced.

16 Claims, 10 Drawing Sheets

IMAGE FORMING APPARATUS HAVING DEVICE FOR DETECTING CONCENTRATION OF DEVELOPING AGENT

BACKGROUND OF THE INVENTION

1. Field of the Invention

The present invention relates to an image forming apparatus having a device for detecting the concentration of a developing agent stored therein and, more particularly, to an image forming apparatus such as a laser printer or an electronic copying machine into which a developing unit can be detachably mounted.

2. Description of the Related Art

In a conventional apparatus for forming an image with a developing agent, a device for detecting the concentration of the developing agent is initialized with reference to a developing agent concentration at the time of shipping or the like. That is, at the time of shipping, the reference developing agent concentration is converted into a reference voltage signal, and this signal is permanently stored as a reference voltage value in the developing unit body. After shipping, when the actual developing agent concentration becomes lower than the reference concentration, the decrease in concentration is detected by the device for detecting the concentration of the developing agent. The device generates a detection signal having a high voltage value. When the detection signal exceeds a predetermined voltage level, a toner is replenished from a toner hopper to a stirrer. The toner is stirred by the stirrer. When the concentration of the developing agent in the stirrer reaches the reference value, replenishment of the toner is stopped.

In a conventional image forming apparatus, however, even if the developing unit at the time of shipping is replaced with a new developing unit, the detection signal level of the developing unit at the time of shipping is given as a reference, thereby controlling the developing agent concentration of the new developing unit. Since developing units are manufactured as single units, the relationships between the voltage levels of detection signals from concentration detecting devices and the developing agent densities vary depending on different developing units. When developing units having different detection characteristics are controlled on the basis of a reference value permanently stored in an image developing apparatus, the developing agent concentration varies whenever the developing unit is replaced with a new one. Therefore, the developing units cannot be optimally controlled depending on the characteristics of the individual developing units. Therefore, the reference developing agent concentration cannot always be maintained to be the reference developing agent concentration in the stirrer. As a result, the quality of the image formed by the image forming apparatus may be degraded. That is, even if the concentration of the developing agent is decreased, the voltage level of the detection signal generated by the concentration detecting device is not increased and the level of the detection signal does not reach the voltage level corresponding to replenishment. Therefore, the toner is not replenished, and the concentration of the developing agent in the developing unit is kept low. As a result, an image having a very low concentration is formed, thus degrading image quality.

When the detection signal from the concentration detecting device is kept at a level equal to or higher than the reference level, the toner is supplied to increase the developing agent concentration in the developing unit. An image having an excessively high concentration is formed, and image quality is therefore degraded.

SUMMARY OF THE INVENTION

It is an object of the present invention to provide an image forming apparatus capable of controlling the concentration of a developing agent to a predetermined concentration even if a developing agent replenishing means is replaced with a new one, and capable of maintaining high image quality.

According to the present invention, there is provided an image forming apparatus comprising:

means for forming a latent image;

means for developing the latent image with a developing agent having a concentration varying as the developing of the latent image proceeds, the developing means having an identification data corresponding to the developing means:

data-generating means for generating first concentration data representing the concentration before the latent image is developed, and also second concentration data representing the concentration varied for developing the latent image;

comparing-storing means for comparing the identification data with a reference identification data before the latent image is developed, and for storing the identification data as a new reference identification data and also storing first concentration data as a new reference concentration data which is generated from the data-generating means and corresponds to the new reference identification data when the identification data is different from the reference identification data; and means for supplying the developing agent to the forming means in order to coincide the second concentration data with the reference concentration data corresponding to the identification data when the identification data is identical to the reference identification data stored in the comparing-storing means.

DETAILED DESCRIPTION OF THE PREFERRED EMBODIMENTS

Figure 1:
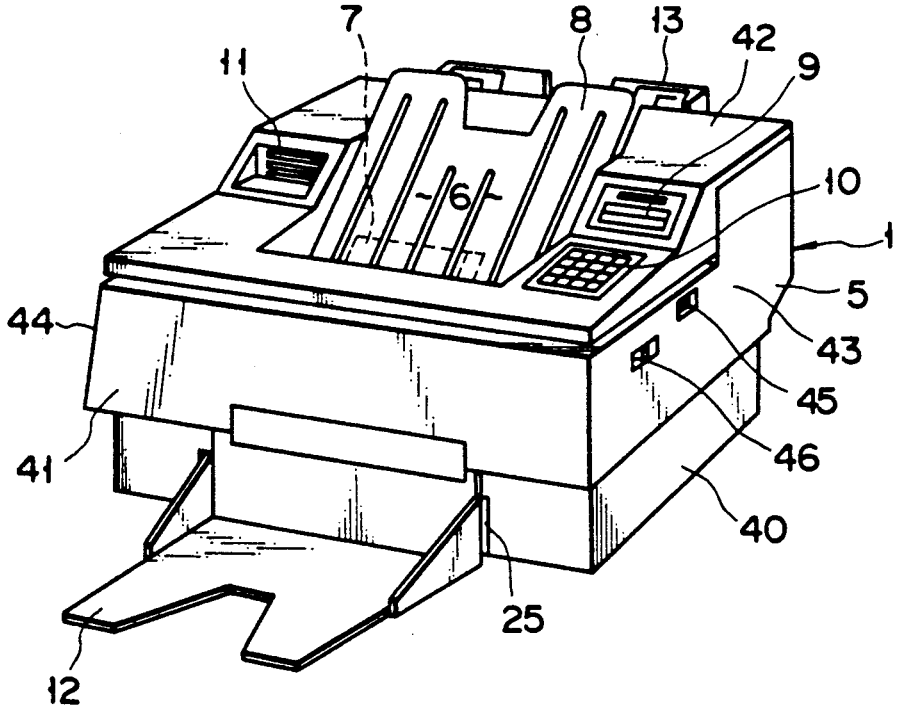
FIG. 1 is a perspective view showing an outer appearance of an image forming apparatus having a concentration detecting device.
Figure 2:
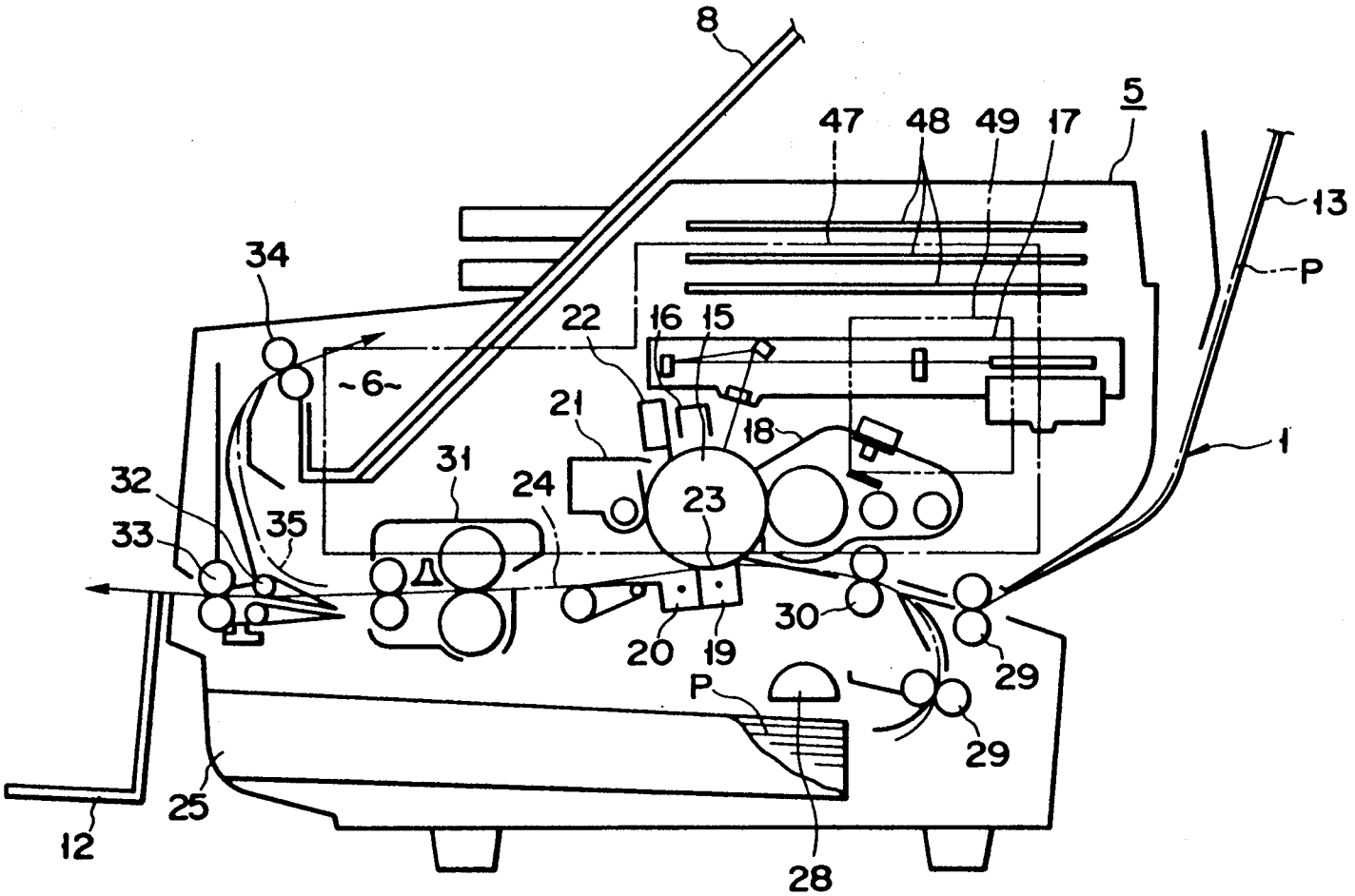
FIG. 2 is a schematic longitudinal sectional view showing an internal structure of the image forming apparatus shown in FIG. 1.

FIGS. 1 and 2 are a perspective view and a schematic longitudinal sectional view of a laser printer as an image forming apparatus according to an embodiment of the present invention. Reference numeral 1 in FIGS. 1 and 2 denotes a laser printer as the image forming apparatus. In laser printer 1, the rear portion of the upper surface of printer body 5 is stepped upward, and recess 6 serving as a discharge portion of printer body 5 is formed at the central portion of the upper surface. Exhaust tray 8 which is movably supported by jogger 7 is mounted in recess 6. Console panel display unit 9 serving as an operation panel and console panel switch unit 10 serving as an input means are arranged to the right of recess 6. Three IC card insertion ports 11 are formed to the left of recess 6.

Figure 3A:
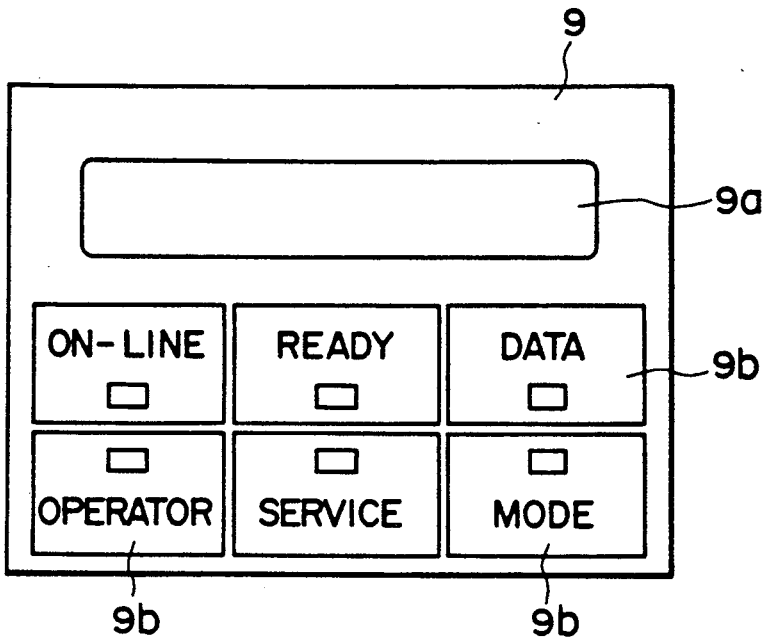
FIGS. 3A and 3B are views showing an arrangement of a display unit of an operation console in the apparatus shown in FIG. 1.
Figure 3B:
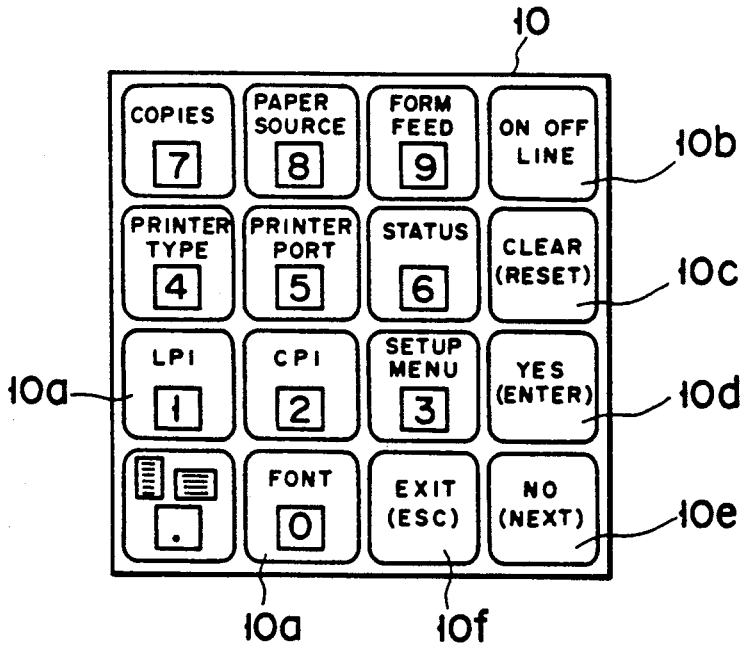

Console panel display unit 9 includes LCD (Liquid Crystal Display) unit 9*a* foi displaying setting conditions of the apparatus, and display unit 9*b* for indicating operating states with LEDs (Light-Emitting Diodes), as shown in FIG. 3A. A copy count or a copy mode is displayed on display unit 9*a*. Display unit 9*b* indicates a mode for representing whether the apparatus is connected to an external device (ON/OFF line mode), a print ready mode, a printing data transfer mode, an operator call mode, a serviceman call mode, and a manual reference mode. Console panel switch unit 10 includes ten-key pad 10*a*, ON/OFF line selection key 10*b*, clear key 10*c*, YES key 10*d*, NO key 10*e*, and EXIT key 10*f*, as shown in FIG. 4B. Keys of ten-key pad 10*a* are used to set a copy count mode, a paper source feed mode, a printing stop/paper exhaust mode, and the like. Clear key 10*c* also serves as a reset key. YES key 10*d* also serves as an enter key. NO key 10*e* also serves as a NEXT key and an INCREMENT KEY. Exit key 10*f* also serves as an ESC key and a DECREMENT key.

Figure 4:
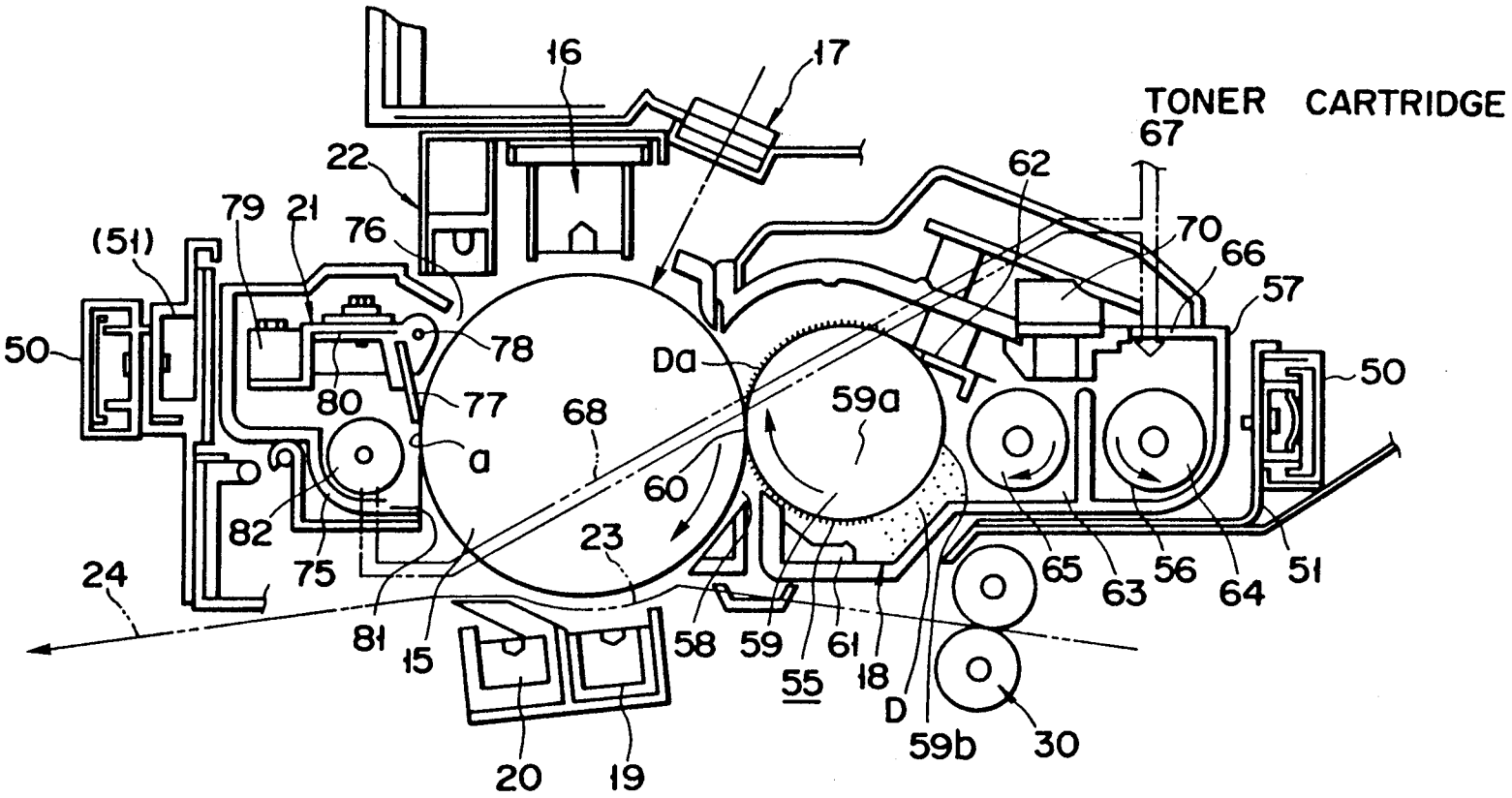
FIG. 4 is a schematic view showing the main part of the image forming apparatus shown in FIGS. 1 and 2.

Exhaust tray 12 is mounted on the front surface of printer body 5, as shown in FIG. 1. Manual feed tray 13 is mounted on the rear surface side. Photosensitive drum 15 serving as an image carrier is disposed at substantially the center of printer body 5. Charger 16, laser optical system 17, developing unit 18 serving as a developing means, transfer unit 19, separating unit 20, cleaner unit 21 serving as a cleaner means, and discharger 22 are sequentially arranged around photosensitive drum 15, as shown in FIG. 4. Convey path 24 extending toward the exhaust side through image transfer section 23 between photosensitive drum 15 and transfer unit 19 is formed in printer body 5. Paper feed roller 28 and paper transfer roller 29 ar arranged such that sheet P automatically fed from paper cassette 25 mounted at the bottom portion of printer body 5 through paper feed roller 28 and paper transfer roller 29 or paper sheet P manually fed from manual feed tray 13 is guide to image transfer unit 23. Aligning roller pair 30 is arranged on the upstream side of image transfer section 23 in convey path 24. Fixing unit 31, exhaust selector 32, and exhaust roller pair 33 are located on the downstream of image transfer section 23. At the terminal end of convey path 24, branch convey path 35 with exhaust roller pair 34 is formed to guide sheet P selected by exhaust selector 32 to recess 6 serving as the exhaust section.

Referring to FIGS. 1 and 2, reference numeral 40 denotes a lower cover; 41, a front cover 42, an upper cover; 43, an openable right cover (door); 44, a left cover; 45, a right cover opening/closing lever; and 46, an upper unit opening/closing lever. Referring to FIG. 2, reference numerals 47, 48, and 49 denote control boards constituting a controller.

The above laser printer is operated in the following manner to form an image. As shown in FIGS. 2 and 4, photosensitive drum 15 is rotated and is uniformly charged by charger 16. The charged surface of photosensitive drum 15 is exposed by a laser beam guided by laser optical system 17, in accordance with an image signal, thereby forming a latent image thereon. The latent image on photosensitive drum 15 is developed by developing unit 18 using two-component developing agent D consisting of a toner and a carrier. The latent image is thus converted into a visible image. The image is then fed to the image transfer section 23 in which the image is transferred onto a sheet.

Figure 5:
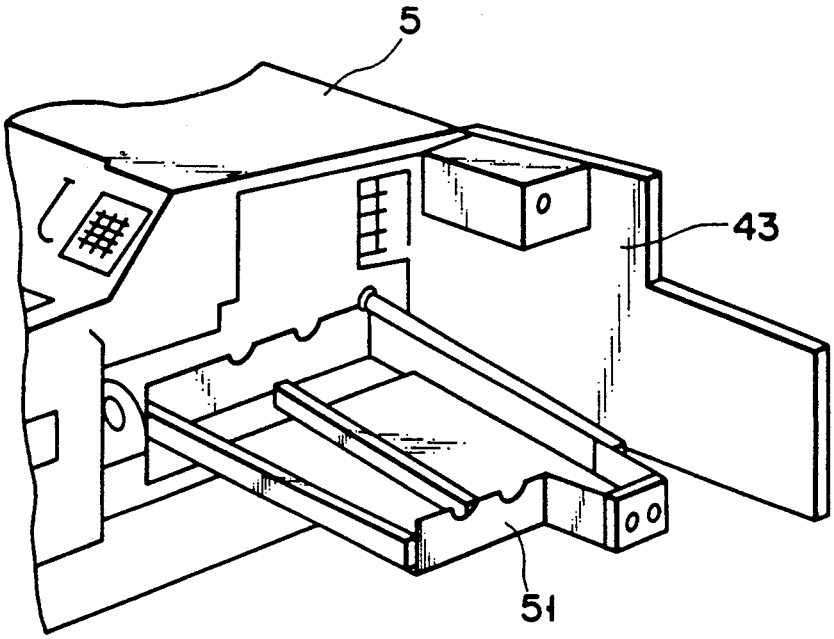
FIG. 5 is a view showing a state wherein a guide frame is mounted on slide rails in a printer unit shown in FIG. 1.
Figure 6:
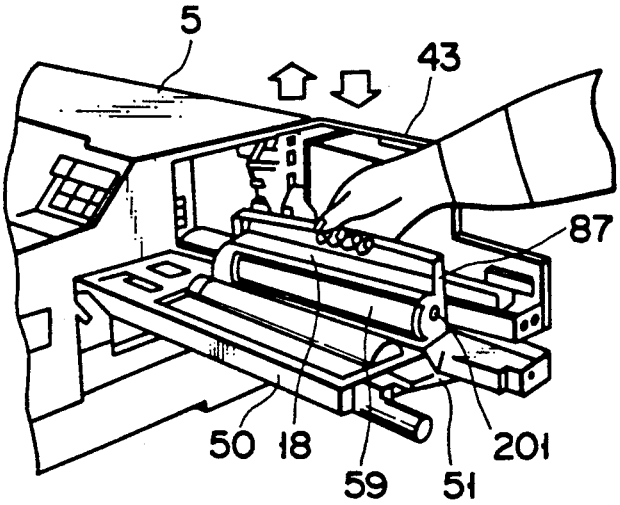
FIGS. 6 and 7 are perspective views for explaining a state wherein a developing unit and a cleaner unit are mounted on the printer unit shown in FIG. 1.
Figure 7:
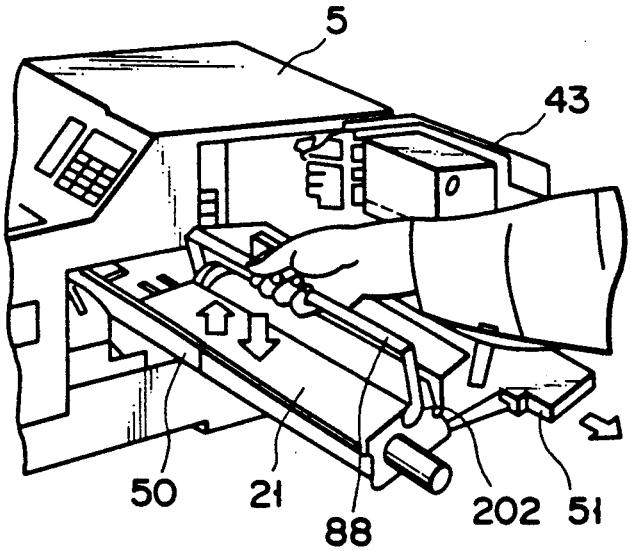

Meanwhile, in synchronism with the operation for forming the developing agent image, sheet P is picked up from paper cassette 25 or sheet P is manually fed. Sheet P is fed to aligning roller pair 30, and the developing agent image formed on photosensitive drum 15 is transferred to sheet P by transfer unit 19. Sheet P is then separated from photosensitive drum 15 by separating unit 20 and is fed to fixing unit 3 through convey path 24. After the developing agent image is melted and fixed on sheet P, the exhaust direction of sheet P is selected by selector 32, so that sheet P is exhausted into upper exhaust tray 8 or front exhaust tray 12. After the developing agent image is transferred to sheet P, the residual toner on photosensitive drum 15 is cleaned by cleaning unit 21, and photosensitive drum 15 is ready for the next copying cycle. As shown in FIG. 6, cleaning unit 21 for cleaning photosensitive drum 15 comprises shaft 201 extending along the central axis of developing roller 59. Both ends of handle 87 are pivotally supported by corresponding ends of shaft 201. When handle 87 is inclined in guide frame 51 and is fitted therein, as shown in FIG. 5, cleaning unit 21 can be accurately fitted in guide frame 51. Similarly, developing unit 18 for developing the latent image on photosensitive body 15 comprises shaft 202 for photosensitive drum 15, as shown in FIG. 7. Both ends of handle 88 are pivotally mounted on corresponding ends of shaft 202. When handle 88 is inclined and fitted in guide frame 51, as shown in FIG. 5, developing unit 18 can be mounted in guide frame 51. Guide frame 51 is slidably supported by slide rails 50. As shown in FIG. 5, guide frame 51 is pulled together with developing unit 18 and cleaning unit 21 along slide rails 50 while right cover 43 of printer body 5 is kept open. Similarly, guide frame 51 can be loaded together with developing unit 18 and cleaning unit 21 into body 5 along slide rails 50. In a state wherein developing unit 18 and cleaning unit 21 are pulled to the right portion of printer unit 5, handle 87 or 88 can be moved from guide frame 51, as shown in FIGS. 6 and 7, so that developing unit 18 or cleaning unit 21 can be removed outside guide frame 51. That is, photosensitive drum 15 and cleaning unit 21 are independent units, so that photosensitive drum 15 and cleaning unit 21 can be removed from guide frame 51 together or separately. At least developing unit 18 can be horizontally held in printer body 5 by guide frame 51.

Figure 8:
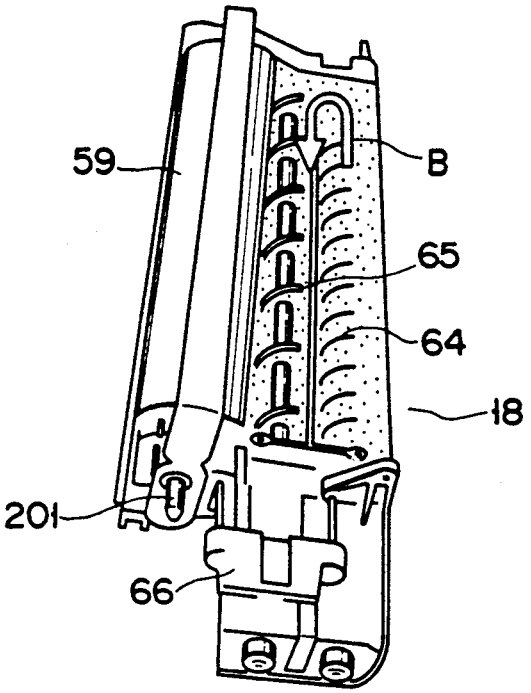
FIG. 8 is a perspective view showing a flow of the developing agent and a stirring blade in the developing unit mounted on the printer unit shown in FIG. 8.
Figure 9:
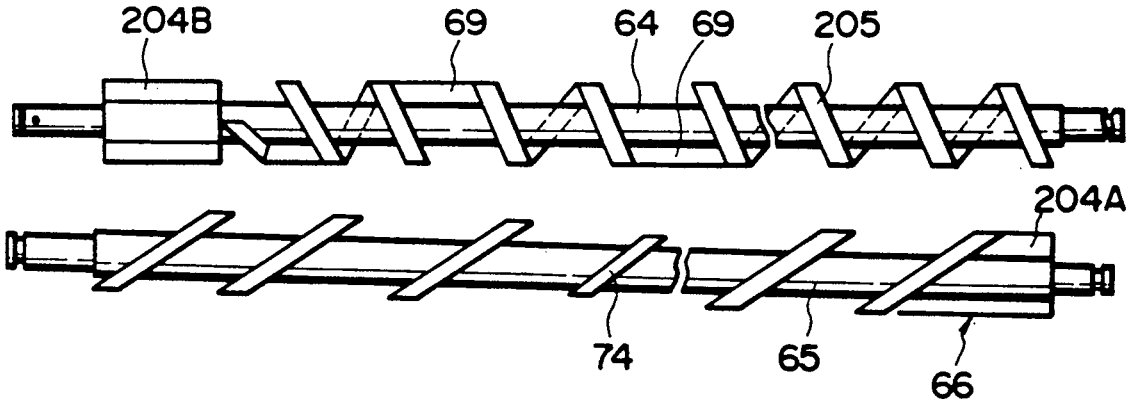
FIG. 9 is a plan view showing the stirring blade in the developing unit shown in FIG. 8.

Developing unit 18 comprises developing mechanism 55 and developing agent stirring section 56, as shown in FIG. 4. In developing mechanism 55, developing roller 59 is disposed to oppose opening 58 of developing unit body 57. Developing agent magnetic brush Da is formed on the surface of developing roller 59. Doctor blade 77 is disposed on the upstream side developing section 60 on the convey path of developing agent magnetic brush Da to control the thickness of developing agent magnetic brush Da supplied to a sliding portion between developing agent magnetic brush Da and photosensitive drum 15 or to developing section 60. Scraper 62 is disposed on the downstream side developing section 60 on the convey path of developing agent magnetic brush Da. Developing agent magnetic brush Da formed on the surface of developing roller 59 is separated by scraper 62 and is guided to developing agent stirring section 56. Stirring section 56 includes developing agent storage section 63 formed behind developing roller 59 with respect to photosensitive drum 15. First and second stirring members 64 and 65 serving as developing agent convey augers, shown in FIG. 8, are disposed in developing agent storage section 63.

Developing roller 59 comprises magnetic roll **59*a* having a plurality of pole pieces and nonmagnetic sleeve 59*b* fitted on magnetic roll 59*a* and rotatable clockwise. As shown in FIG. 4, toner reception section 66 is formed to oppose developing agent stirring section 56 in developing unit body 57 to receive the developing agent therein. The toner replenished from toner cartridge 67 for replenishing the developing agent and the toner returning from cleaning unit 21 through return path 68 for returning the developing agent are received in developing agent stirring section 56 through reception section 66. Developing agent concentration sensor 70 is arranged to oppose scraper 62 to detect the concentration of the developing agent. A toner replenishment shaft (not shown) built into toner cartridge 67 is driven independently of printer body 5 in response to the detection signal from developing agent concentration sensor 70, thereby supplying the toner to developing agent stirring section 56**.

Particles of developing agent D are attracted by the lines of magnetic force generated by the respective pole pieces to form magnetic brush Da on the surface of nonmagnetic sleeve **59*b*. Developing agent magnetic brush Da is continuously conveyed to developing section 60 upon rotation of sleeve 59*b*. The toner particles in magnetic brush Da are attracted to the latent image on photosensitive drum 15, so that the latent image is developed. Upon rotation of developing agent stirring members 64 and 65 disposed in developing agent storage section 63**, developing agent D is stirred to bring the toner and carrier into frictional contact with each other. Therefore, the toner can be effectively charged.

Developing agent D is conveyed while being stirred by stirring members 64 and 65 in developing agent storage section 63. More specifically, the toner replenished from toner replenishing port 66 is fed to the stirring member 64 side by flat U-turn blade **204*a* and is immediately conveyed by convey blade 205. The toner is sufficiently stirred by stirring blade 6 arranged midway along the shaft. The toner is then fed to the stirring member 65 side by flat U-turn blade 204*b*. Thereafter, the flow of developing agent D is changed by small blade 74 located at the center of the shaft along its axial direction. By utilizing the change in flow, the concentration of the developing agent is detected (to be described later). Developing agent stirring members 64 and 65 are horizontally arranged in developing unit 18 so as to eliminate an adverse influence of conveyance of developing agent D, i.e., prevent a convey failure. A stirring blade is not formed at a developing agent stirring member 64 portion corresponding to toner reception section 66** in order to prevent delay of toner detection and toner clogging. Only the convey blade is formed at this portion.

Figure 10:
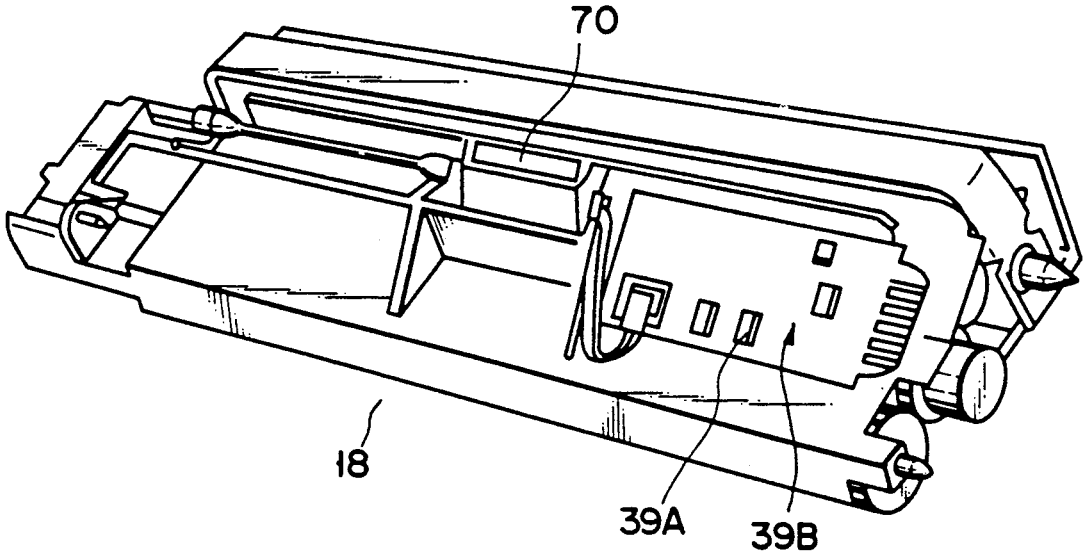
FIG. 10 is a perspective view of the developing unit mounted on the printer unit shown in FIG. 1.
Figure 11:
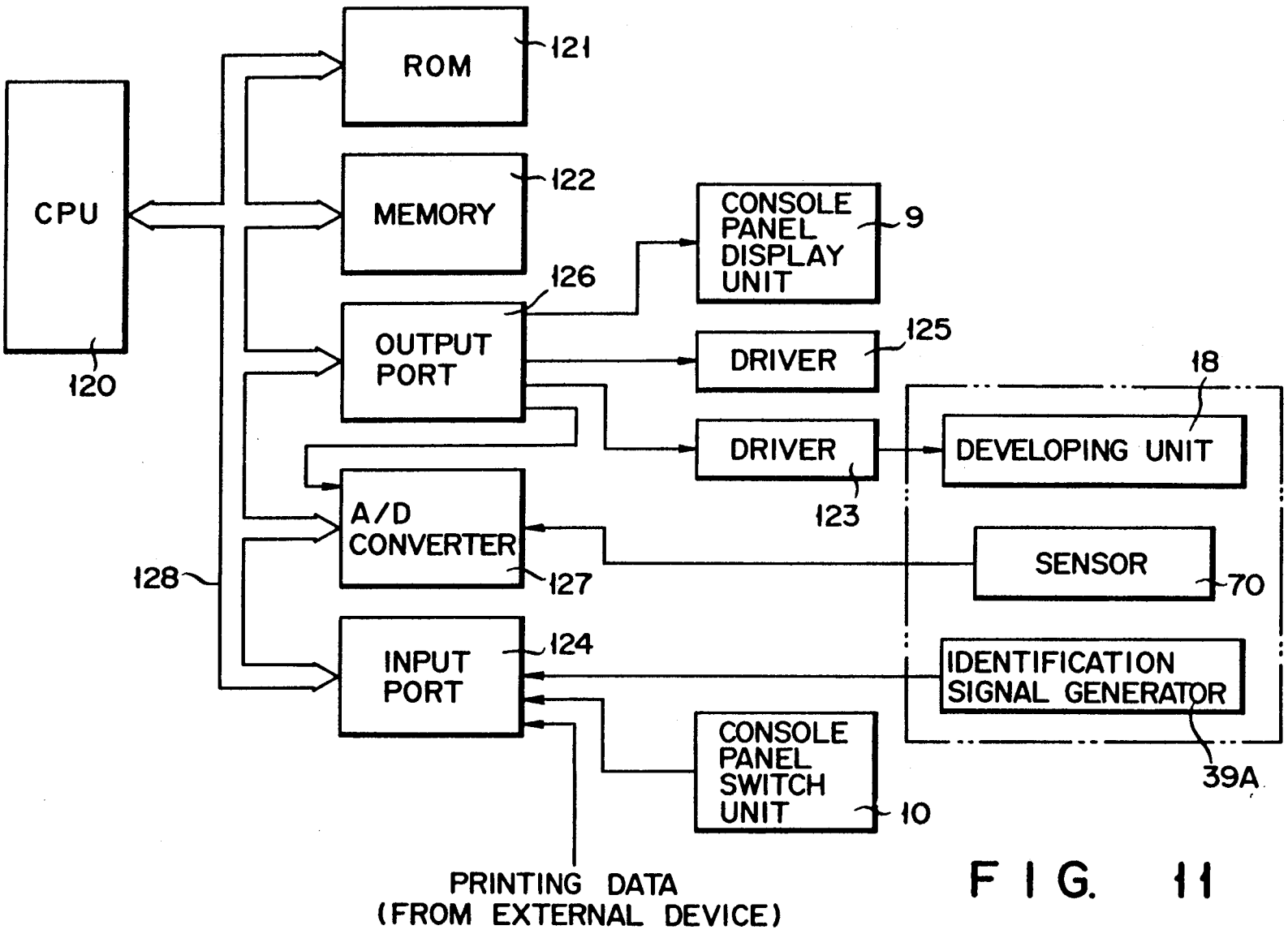
FIG. 11 is a block diagram showing the main part of an electrical circuit incorporated in the printer unit shown in FIG. 1.

Concentration detection and control of the developing agent will be described below. As shown in FIG. 10, developing unit 18 has board 39B having identification signal generator 39A for generating an identification signal for designating the developing unit, i.e., old and new developing units, and manufacturing no. of the developing unit, and sensor 70 for detecting the concentration of the developing agent. An operation for removing old developing unit 18 from the laser printer and mounting new developing unit 18 will be described. When developing agent D having a concentration controlled to a predetermined value is stored in developing unit 18, and unit 18 is loaded in laser printer body 5, laser printer body 5 determines whether loaded developing unit 18 is a new or old one in accordance with a signal from identification signal generator 39A on board 39B. Only when laser printer body 5 determines that the loaded developing unit is a new one, operating conditions, e.g., count data representing the number of prints, stored in a nonvolatile memory such as $E^2$PRAM, i.e., memory 122 in printer body 5 shown in FIG. 11 are set. Thereafter, the concentration of developing agent D is kept constant, i.e., the toner is no longer supplied, and the printer body is driven to start stirring of the developing agent in developing unit 18. When the flow of developing agent D in developing unit 18 is stabilized, e.g., when about two minutes have elapsed after stirring of the developing agent in developing unit 18 is started, the concentration of the developing agent in developing unit 18 is detected by concentration sensor 70. A detection signal from sensor 70 is converted into a voltage signal. This voltage signal is stored as an initial voltage signal, e.g., a reference voltage signal corresponding to the reference concentration in a memory, e.g., nonvolatile memory 122 in printer body 5 shown in FIG. 11. Concentration control of developing unit 18 is started on the basis of the stored voltage value. Refer to U.S. patent application No. 369,826 for concentration sensor 70 and a method of detecting the concentration of the developing agent with sensor 70.

Cleaning unit 21 comprises case 75 having opening 76 opposite to photosensitive drum 15, as shown in FIG. 4. Cleaning blade 77 is arranged in case 75 of the cleaning unit. The upper end portion of cleaning blade 77 is fixed to blade holder 80 such that blade 77 is pivotal about shaft 78 and always biased counterclockwise by counterweight 79 in a state shown in FIG. 4. The lower end portion of cleaning blade 77 is urged against the outer surface of photosensitive drum 15. After the toner is transferred from photosensitive drum 15 to the sheet, the toner left on photosensitive drum 15 and reaching cleaning blade 77 is removed by cleaning blade 77.

Recovery blade 81 is mounted at the lower edge of opening 76. Recovery blade 81 recovers the toner removed by cleaning blade 77 into cleaning unit case 75. Toner recovery auger 82 is arranged at the bottom portion of case 75 to transfer the recovered toner to return path 68.

An operation of the printer system described above will be described with reference to a control circuit of the laser printer shown in FIG. 11. As shown in FIG. 11, CPU 120 for controlling the operation of the overall printer system is connected to input and output ports 124 and 126, A/D converter 127, ROM 121 for storing control programs, and memory 122 comprised of a nonvolatile RAM through data bus 128. Memory 122 stores an identification number (i.e., confidential number) for identifying developing unit 18 which is identified during data updating, a count, a reference voltage signal, and sheet data (e.g., top margin, left margin, and type of paper).

In such a control circuit, a control program is supplied from ROM 121 to CPU 120 through input port 124 on the basis of a command from console panel switch 10. Print data is supplied from an external device to CPU 120 through the input port and is processed. An operation command is supplied to console panel display unit 9, driver 125 for driving a toner supply mechanism, and driver 123 for driving the developing unit through output port 126. Drivers 123 and 125 are driven to operate the respective parts of the printer, as described above, thereby printing information on the sheet. During such a printing operation, in order to form a normal image, the concentration of the developing agent in developing unit 18 is detected by concentration sensor 70. A detection signal from sensor 70 is converted into a digital signal by A/D converter 127 controlled by a control signal from the output port. The digital signal is compared with the reference concentration of developing unit 18 which is stored in memory 122 by CPU 120. If the detected concentration is lower than the reference concentration, driver 125 is driven in accordance with the command from CPU 120, and the toner is supplied from toner cartridge 67 to developing unit 18. When the concentration of the toner of the developing agent in developing unit 18 reaches the reference concentration, driver 125 is deenergized by the command from CPU 120. Supply of the toner from toner cartridge 67 to developing unit 18 is stopped.

Figure 12:
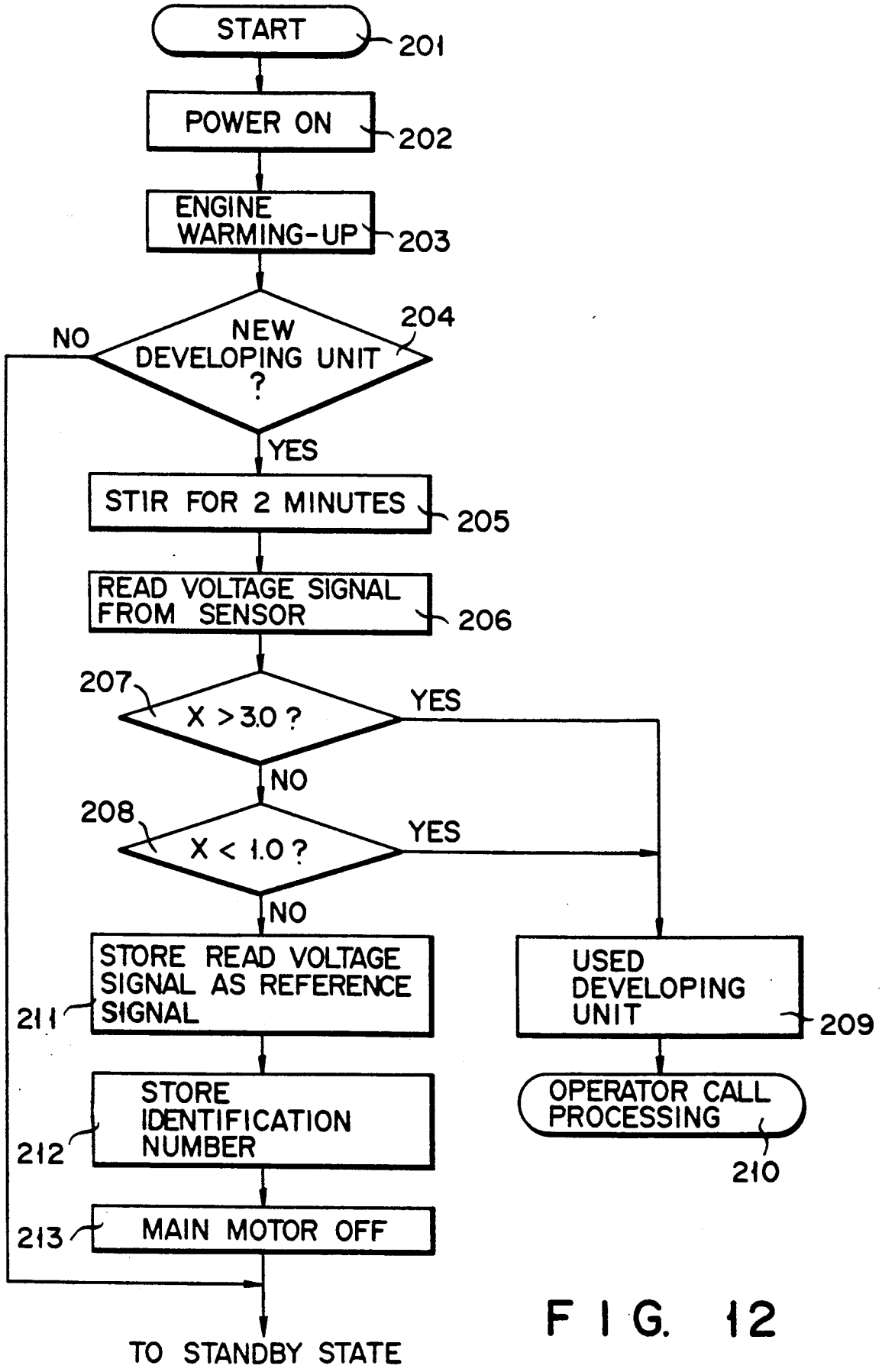
FIG. 12 is a flow chart for explaining the circuit shown in FIG. 11 and the respective parts associated with the circuit.

The data representing the number of prints, stored in memory 122 is updated upon every printing. When the number of prints reaches a predetermined number, CPU 120 generates a command for designating replacement of the developing unit to console panel display unit 9 since the service life of developing unit 18 is ended. Display unit 9 displays need for replacement of the developing unit in accordance with this command. An operator observes this display and turns off the power of the printer system. As described with reference to FIGS. 6 and 7, developing unit 18 and cleaning unit 21 are replaced with new ones, respectively. When replacement is completed, in steps 201 and 202 in FIG. 12, the switch is turned on again. In response to power-on operation, the drive system is warmed up in accordance with the command from CPU 120 in step 203. For example, a heater is energized, a main motor is turned on, the start of the mirror motor is checked, and developing agent D in new developing unit 18 is stirred. An identification signal of developing unit 18 which is generated by identification signal generator 39A is supplied to CPU 120 and is compared with that of old developing unit 18 which is already stored in memory 122 in step 204. When replacement of developing unit 18 is not performed, two identification numbers coincide with each other. In this case, the identification number data in memory 122 is not updated, and the printer is kept in the standby mode. However, if developing unit 18 is replaced with a new one and the two identification numbers do not coincide with each other, developing unit 18 is determined to be a new one. In this state, the developing agent in developing unit 18 is sufficiently (e.g., for two minutes) stirred. When the concentration of the toner in the developing agent is stabilized, this concentration is detected by sensor 70 in step 206. A detection signal from concentration sensor 70 is converted into a digital signal by A/D converter 127 controlled by the control signal from the output port so that the detection signal is fetched to CPU 120 a plurality of times. CPU 120 calculates an average value of the detection signals. In steps 207 and 208, CPU 120 determines whether the average concentration level falls within a predetermined reference range, e.g., 3.0 V to 1.0 V as the voltage signal level. If the concentration level falls outside the predetermined reference range, developing unit 18 is determined to be defective in step 209. A message representing a defective developing unit is displayed on display unit 9 in step 210. The operator replaces the developing unit again upon checking of the display. Even if the replaced developing unit is a used one, such a mistake can be checked.

When the average concentration level falls within the predetermined reference range, a voltage signal corresponding to this concentration level is stored as a reference signal in memory 122 in step 211. The concentration level data is updated, and CPU 120 clears the old identification data stored in memory 122 and at the same time causes identification signal generator 39A of developing unit 18 to supply an identification number to memory 122. Therefore, the identification signal data can be updated. CPU 120 generates a command for turning off a main motor (not shown), and the printer is kept in the standby mode.

Thereafter, upon each image formation, a voltage value supplied from concentration sensor 70 is compared with the reference value stored in memory 122, and the toner concentration is controlled in accordance with the comparison result.

According to the present invention as has been described above, there is provided an image forming apparatus wherein the developing agent concentration corresponding to each developing means can be controlled and image quality can be improved.

What is claimed is:

1. An image forming apparatus comprising:

means for forming a latent image;

means for developing the latent image with a developing agent, which is detachably mounted in said image forming apparatus and has an identification data unique to said developing means, the developing agent being preset to a predetermined initial toner concentration before said developing means is mounted in said apparatus and the toner concentration being varied from the initial toner concentration in a developing process;

means for detecting the toner concentration of the developing agent to generate first and second concentration signals which correspond to the initial and varied toner concentrations, respectively;

means for transferring the identification data and the concentration signal;

means for storing reference data, and for receiving and comparing the transferred identification data and concentration signals to the reference data, the identification data and the first concentration signal being stored as the reference data in said storing means when the identification data is different from the reference data; and means for comparing the second concentration signal with the first concentration signal, to supply the toner to said developing mans and maintain the developing agent within a predetermined toner concentration range.

2. An apparatus according to claim 1, wherein said developing means includes means for stirring the developing agent.

3. An apparatus according to claim 2, wherein said developing means is detachably mounted in said image forming apparatus and said comparing-storing means compares the identification data with the reference data after said developing means is mounted in said apparatus and the developing agent is stirred.

4. An apparatus according to claim 1, wherein said developing means includes means for generating the identification data.

5. An apparatus according to claim 1, wherein said comparing-storing means includes means for indicating the need for a replacement of said developing means when the developing operation is performed a predetermined number of times.

6. An apparatus according to claim 1, wherein comparing-storing means stores the identification data when the first concentration data falls within a predetermined range.

7. An apparatus according to claim 1, wherein said developing means is detachably mounted in said image forming apparatus and said storing means accesses the identification data after said developing means is mounted in said apparatus.

8. An apparatus according to claim 1, wherein said comparing-storing means updates the reference data with the identification data and the first concentration data being linked to each other when the identification data is different from the reference data.

9. An image forming apparatus comprising:

means for forming a latent image;

means for developing the latent image with a developing agent, said developing means having identification data unique to said developing means, and the developing agent having an initial concentration before the latent image is developed and a second concentration which varies as developing of the latent image proceeds;

means for detecting the initial and second concentrations to generate first and second data, respectively;

means for updating and storing reference identification data and reference concentration data, and for comparing the unique identification data with the reference identification data and comparing the second concentration data with the reference concentration data, the reference identification data and the reference concentration data being updated and the unique identification data and the initial concentration data being stored as the updated reference identification data and the reference concentration data, respectively, when the unique identification data differs from the reference identification data; and means for supplying the developing agent to said forming means in order to coincide the second concentration data with the stored reference concentration data.

10. An apparatus according to claim 9, wherein said developing means includes means for stirring the developing agent.

11. An apparatus according to claim 10, wherein said developing means is detachably mounted in said image forming apparatus and said comparing-storing means compares the identification data with the reference data after said developing means is mounted in said apparatus and the developing agent is stirred.

12. An apparatus according to claim 9, wherein said developing means includes means for generating the identification data.

13. An apparatus according to claim 9, wherein said comparing-storing means includes means for indicating the need for replacement of said developing means when the developing operation is performed a predetermined number of times.

14. An apparatus according to claim 9, wherein said comparing-storing means stores the identification data when the first concentration data falls within a predetermined range.

15. An apparatus according to claim 9, wherein said developing means is detachably mounted in said image forming apparatus and said comparing-storing means accesses the identification data after said developing means is mounted in said apparatus.

16. An apparatus according to claim 9, wherein said comparing-storing means updates the reference data with the identification data and the first concentration data being linked to each other when the identification data is different from the reference data.

* * * * *